United States Patent [19]

Ockey

[11] 3,955,671

[45] May 11, 1976

[54] SHIPPING AND DISPLAY CARTON

[75] Inventor: Gary B. Ockey, San Francisco, Calif.

[73] Assignee: The Clorox Company, Oakland, Calif.

[22] Filed: Jan. 16, 1975

[21] Appl. No.: 541,405

[52] U.S. Cl. ..... 206/44 R; 53/392; 229/23 BT

[51] Int. Cl.[2] ..... B65D 5/50; B65D 85/62

[58] Field of Search ..... 206/44 R, 45.14, 45.11, 206/461; 229/9, 19, 23 BT, 45, 23 R; 53/247, 390, 392

[56] References Cited

UNITED STATES PATENTS

| | | | |
|---|---|---|---|
| 2,178,091 | 11/1939 | Weiss | 206/44 R |
| 2,358,614 | 9/1944 | Arbuthnot | 229/23 R |
| 2,435,355 | 2/1948 | Ingram, Sr. | 229/9 |
| 2,544,565 | 3/1951 | Phillips | 229/45 |
| 2,729,375 | 1/1956 | Pace | 53/247 |
| 3,208,583 | 9/1965 | Kamps | 206/44 R |

*Primary Examiner*—William T. Dixson, Jr.
*Attorney, Agent, or Firm*—Phillips, Moore, Weissenberger Lempio & Strabala

[57] ABSTRACT

A carton for shipping and displaying a plurality of food packets or the like includes a generally rectangular, open-top member adapted to receive a plurality of food packets for packing and shipping, and a truncated member adapted to close telescopically over the rectangular member. The carton members are provided with a tab and slot respectively to lock them together for shipping. One side of the truncated member includes an edge forming an axis about which the rectangular member can be manually rotated to disengage the interlocking tab and slot, allowing the rectangular member to be slidably removed from the trapezoidal member and the food packets whereby the food packets will be retained in the trapezoidal member for display.

Finger holes are provided in the rectangular carton member for easy manual manipulation thereof.

8 Claims, 9 Drawing Figures

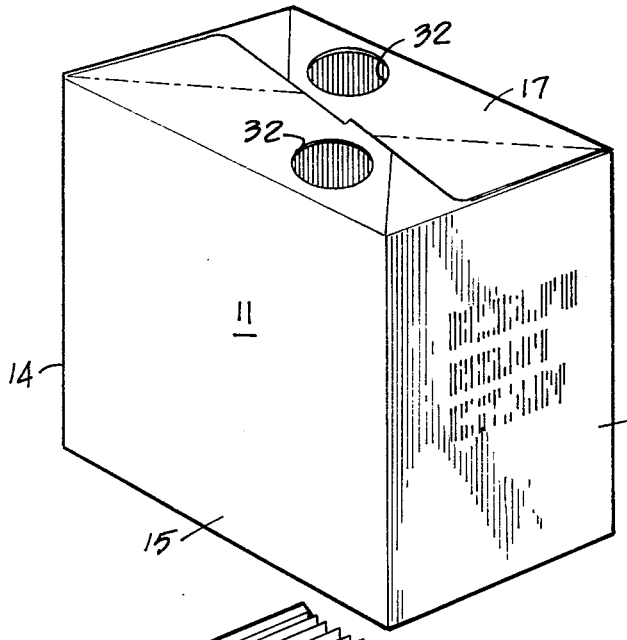
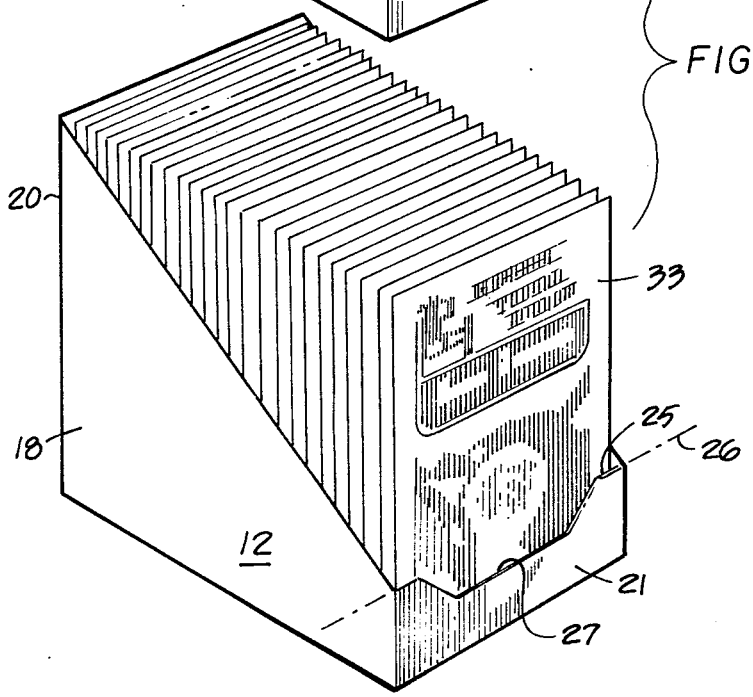
FIG. 8.
FIG. 7.
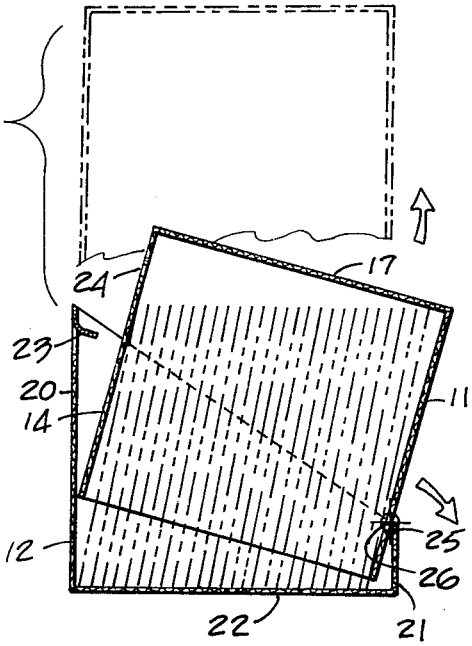
FIG. 9.
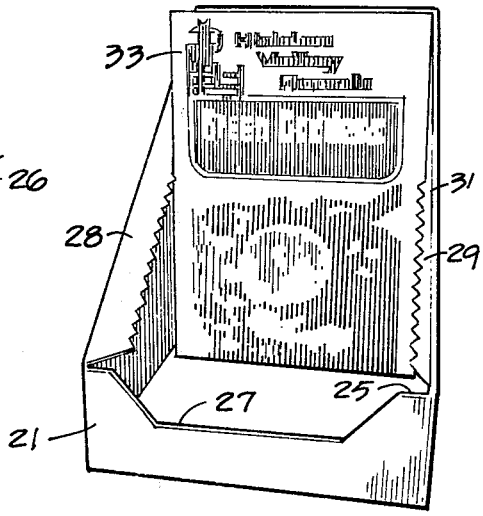

SHIPPING AND DISPLAY CARTON

BACKGROUND OF THE INVENTION

This invention relates to cartons adapted for shipping and displaying a plurality of paper or laminate packets or pouches which are widely used in packaging various types of food. Such packets are commonly displayed for sale in grocery stores and the like by arranging a plurality of such packets in closely spaced parallel relationship retained within a truncated carton member.

Prior patents of general interest in this area include the following:

| | |
|---|---|
| 3,280,968 | 1,524,879 |
| 3,670,872 | 1,065,922 |
| 2,796,978 | 2,998,879 |
| 2,592,678 | 3,172,530 |
| 3,341,271 | 1,901,483 |
| 776,042 | 1,932,429 |
| 2,446,366 | 3,669,251 |

Some of this prior art shows cartons comprising telescoping carton portions. However, none of the prior art shows the unique means of fastening the cartons together that is provided by the present invention. Furthermore, none of the prior art carton portions are configured to provide a means for easily disengaging the fastening means for opening the carton.

It is an object of the present invention to provide a combined shipping and display carton for a plurality of packets that will require a minimum amount of manual manipulation of the carton for either shipping or display of the packets.

Another object of this invention is to provide a shipping carton for a plurality of packets which can be easily closed and secured to retain the packets for shipping without the requirement of any adhesive or other fastening means apart from the carton itself.

Another object of this invention is to provide a shipping and display carton for a plurality of packets whereby the carton may be securely closed for shipping but easily opened for display of the contents therein.

Another object of this invention is to provide a shipping and display carton for a plurality of packets whereby the packets will be arranged and retained for attractive display thereof upon opening of the carton.

BRIEF SUMMARY OF INVENTION

The present invention provides a carton for shipping and displaying a plurality of thin food packets or pouches. The carton includes an open-top rectangular carton member having parallel, opposed sides and a bottom of which may be the type that is formed automatically upon flexing of the side wall panels. The rectangular carton member is adapted to receive and closely retain a plurality of inverted food packets in closely spaced parallel relationship. A truncated carton member is provided which is adapted to slide telescopically over the rectangular carton member to form a complete closure therewith. The truncated rectangular carton member has spaced parallel side walls of trapezoidal configuration joining spaced parallel end walls of rectangular configuration. One of the said rectangular end walls is congruent with an end wall of the rectangular carton member, and is provided with a tab which is adapted to engage a slot provided in the end wall of the rectangular carton member to lock the respective carton members together against relative telescopic sliding thereof.

The other rectangular end wall of the truncated carton member forms an edge providing an axis about which the rectangular carton member may be rotated to disengage the tab from the slot, allowing the rectangular member to be separated from the truncated carton member for display of the food packets. The height of the other rectangular end wall is chosen to retain the carton members together but to allow the rectangular member to be forcibly rotated with respect to the truncated member.

BRIEF DESCRIPTION OF THE DRAWINGS

In the drawings:

FIG. 7 is a cross-section of the shipping and display carton of the present invention showing rotation of the rectangular member for disengagement of the tab and slot.

FIG. 8 is a perspective view of the shipping and display carton of the present invention showing removal of the rectangular carton member from the truncated carton member for display of the food packets shipped therein, and FIG. 9 is a perspective view of the truncated carton member of the present invention employed to display the packets shipped therein.

DETAILED DESCRIPTION OF THE PREFERRED EMBODIMENT

Figure 3:
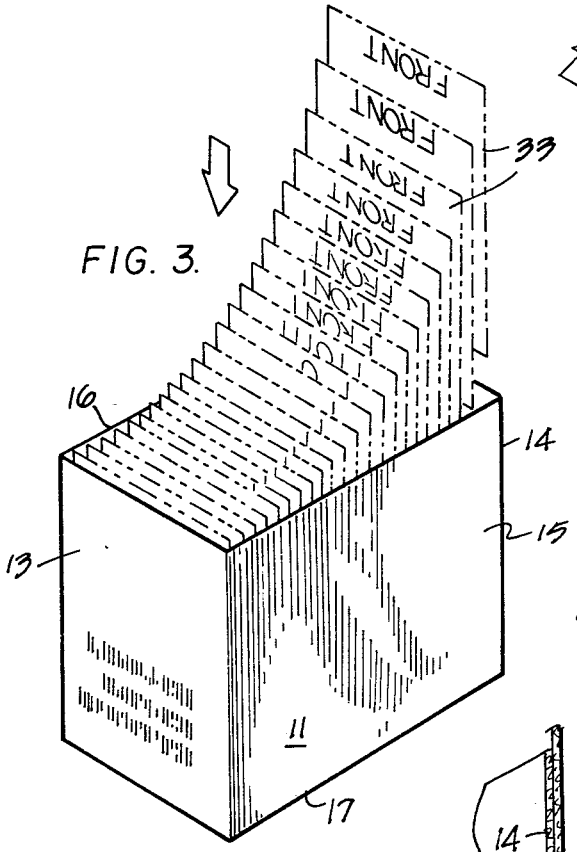
FIG. 3 is a perspective view of the rectangular carton member of the present invention shown in its erected form and arranged to receive a plurality of packets in parallel inverted relationship.
Figure 5:
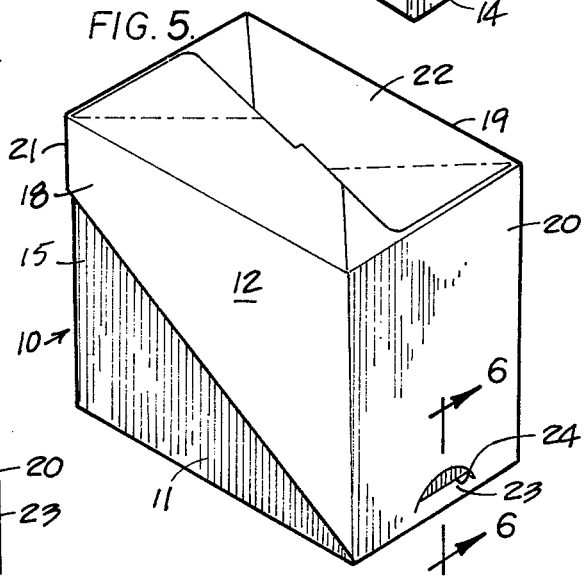
FIG. 5 is a perspective view of the shipping and display carton of the present invention.

Referring to FIGS. 3 and 5, the shipping and display carton of the present invention is shown generally at 10 and comprises a rectangular carton member 11 and a truncated carton member 12 adapted to fit telescopically over the rectangular carton member 11 to form a closure therewith.

Figure 1:
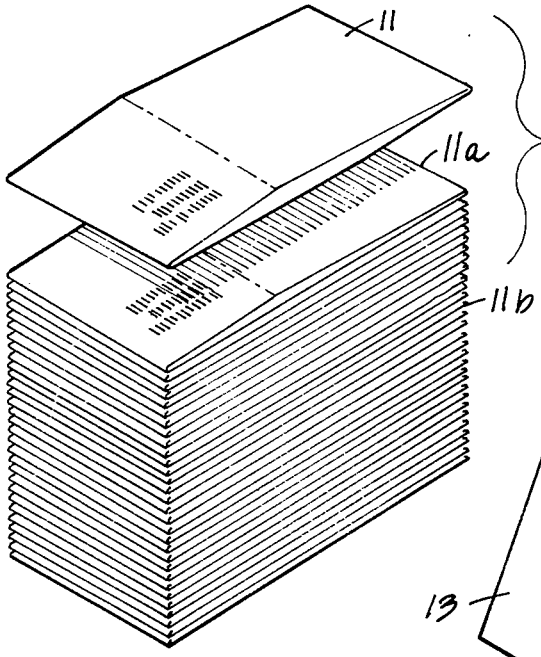
FIG. 1 is a perspective view of a plurality of rectangular carton members of the present invention prior to final erection.
Figure 2:
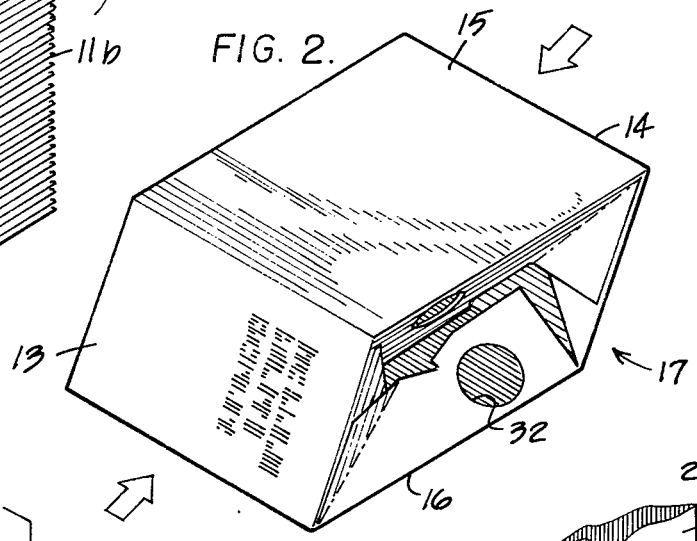
FIG. 2 is a perspective view of a rectangular carton member of the present invention showing how it may be erected into its final configuration by manually applying a couple thereto.

As shown in FIGS. 2 and 3, rectangular carton member 11 has spaced parallel rectangular ends 13 and 14, and spaced parallel sides 15 and 16 joined together by a bottom 17 of the automatic forming type which is well-known in the art. The method of constructing such an open-top rectangular carton having automatic forming bottom is well-known in the art and will not be further discussed. It will be recognized by those skilled in the art that such carton members may be easily provided in a folded and stacked condition as shown in FIG. 1. The formation of the carton member can be completed by application of a couple thereto whereupon the side walls will flex to form the carton member and the automatic bottom 17 will snap together to form a closure with the side walls at the bottom of the carton member.

Referring now to FIGS. 5 and 8, the truncated carton member comprises spaced trapezoidal side walls 18 and 19 joining first and second spaced, parallel, rectangular end walls 20 and 21 respectively.

The walls of truncated carton member 12 are also joined together by an automatically formable bottom 22 whereby the truncated carton member may be preformed and stacked in a folded condition for final assembly in a manner similar to that of the rectangular carton member 11, shown in FIG. 1.

Truncated carton member 12 is adapted to fit telescopically over the rectangular member 11 to form a closure therewith, and is provided with a tab 23 formed near the top of end wall 20 which is adapted to mate with a slot 24 provided near the bottom of end wall 14 of rectangular carton member 11 to slidably lock the respective carton members together during shipping.

As shown in FIGS. 7 and 8, second rectangular end wall 21 is not as high as the corresponding end wall of the rectangular carton member, and includes a top edge 25 which forms an axis 26 about which rectangular carton member 11 may be rotated as shown in FIG. 7 by exerting sufficient force to cause the end walls of the respective cartons to flex sufficiently to allow sufficient rotation to disengage tab 23 from slot 24, allowing rectangular carton member 11 to be slidably removed from the truncated carton member.

The amount of rotation of rectangular carton member 11 about axis 26 to disengage tab 23 from slot 24 will depend upon the height of the front end wall of truncated member 12, the length of the carton members, and the height of the tab above axis 26. Since tab 23 and slot 24 prevent relative rectilinear movement of the carton members, tab 23 and slot 24 should be so located with respect to axis 26 that upon initial rotation of the rectangular member withdrawal of the tab from the slot progresses faster than lateral displacement thereof. Accordingly, it is suggested that a straight line between axis 26 and slot 24 be 45° or more to the bottom of the truncated carton member although the carton will function properly if the angle is slightly less than 45°.

It will be apparent that premature or inadvertant rotation of the rectangular carton member whereby tab 23 is released from slot 24 allowing the carton members to separate is undesirable. The higher that front wall 25 and axis 26 is, the more the end walls of the truncated carton member will resist rotation of the rectangular carton member. Accordingly, front end wall 25 should be sufficiently high to provide the desired amount of resistance to rotation of the rectangular carton member. Edge 25 may be partially relieved, as shown at 27, to enhance viewing of packets displayed within the truncated carton member.

As shown in FIG. 9 the upper edges of trapezoidal side wall 18 and 19 are provided with serrated flaps 28 and 29 which are joined to side walls 18 and 19 by score lines 30 and 31 respectively, to retain food packets disposed within the truncated carton member in an upright position as respective packets are removed from the carton member.

Finger holes 32 may be provided in the bottom of rectangular carton member 11 to facilitate manual rotation and sliding thereof with respect to carton member 12 for removal.

Figure 4:
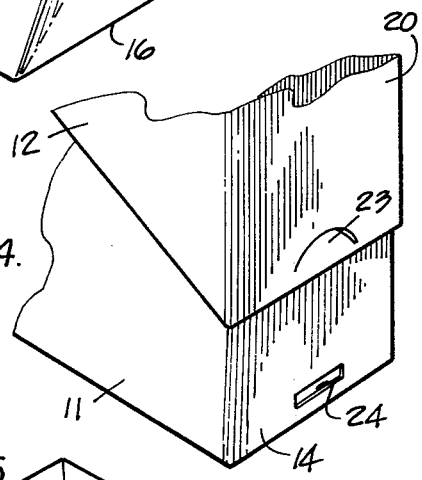
FIG. 4 is a fragmentary perspective view of the carton members of the present invention showing the tab and slot provided therein.
Figure 6:
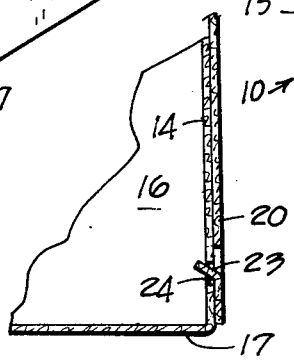
FIG. 6 is a fragmentary cross-sectional view taken along the line and in the direction indicated by the arrows 6-6 in FIG. 5.

The significant advantages of a shipping and display carton constructed in accordance with the foregoing description will be readily recognized by those skilled in the art. A plurality of each of the carton members, folded and arranged in a stack as shown in FIG. 1, may be supplied to a filling station where they may be quickly erected into final form by flexing as shown in FIG. 2. The open-top rectangular member 11 may then be arranged to receive a plurality of inverted packets 33. After filling of the rectangular carton member 11 is completed, truncated carton member 12 may be telescopically slid over carton member 11 to form a closure therewith as shown in FIGS. 4 and 5, and locked together with carton member 11 by manually depressing tab 23 into slot 24. The serrated flaps of the truncated member will be folded downward against the inside side walls of carton member 12 by carton member 11. As shown in FIG. 6, tab 23 disposed in slot 24 prevents relative telescopic sliding of the carton members so that they will not become separated during shipping. This interlocked combination of rectangular carton member 11 and truncated carton member 12 results in a securely closed shipping carton which facilitates shipping and handling of a plurality of packets disposed within.

Typically, a plurality of cartons 10 will be packed and shipped in a corrugated bulk master shipping box. The cartons will be inverted prior to placement in the master shipping box whereby the finger holes will be on top to facilitate removal of the cartons from the master shipping box. Accordingly, when the packets are ready for display upon a grocery store shelf or the like, carton 10 will be inverted whereby member 12 is on the bottom and member 11 is on the top. Rectangular carton member 11 is then rotated about edge 25 of carton member 12 as shown in FIG. 7 until tab 23 is disengaged from slot 24. Thereupon member 11 may be removed slidably upward from member 12, leaving the packets displayed within the truncated carton member as shown in FIGS. 8 and 9, and releasing the serrated flaps to engage the upstanding packets.

What is claimed is:

1. A carton for shipping and displaying a plurality of packets or the like comprising an open-top carton member, and a second carton member configured to fit over the open top of the first carton member in telescopic relation with the first carton member to form a carton therewith, one of said first and second carton members defining tab means, the other of said first and second carton members defining slot means positioned to mate with said tab means, with the first and second carton members forming said carton, to lock the first and second carton members together and prevent relative telescopic separation thereof, and wherein one carton member is provided with means defining an axis whereby one of said carton members may be rotated about said axis relative to the other of said carton members to disengage the tab means from the slot means.

2. The shipping and display carton defined in claim 1 wherein said second carton member includes spaced side walls, and parallel, spaced, end walls, and wherein one of said end walls includes edge means defining said axis whereby the first carton member may be rotated sufficiently while the carton members are telescopically joined together to disengage the tab means from the slot means.

3. A carton for shipping and displaying a plurality of packets or the like comprising an open-top carton member, and a second carton member configured to fit over the open top of the first carton member in telescopic relation with the first carton member to form a carton therewith, one of said first and second carton members defining tab means, the other of said first and second carton members defining slot means positioned to mate with said tab means, with the first and second carton members forming said carton, to lock the first and second carton members together and prevent relative telescopic separation thereof, and wherein said second carton member includes parallel, spaced, trapezoidal side walls, and parallel, spaced, end walls, and wherein one of said end walls includes a top edge defining an axis about which the first carton member may be rotated sufficiently while the carton members are telescopically joined together to disengage the tab means from the slot means.

4. The carton defined in claim 3 wherein said one end wall is sufficiently high to resist in cooperation with said other end wall inadvertent rotation of the first carton member to release the tab means from the slot means.

5. The carton defined in claim 3 wherein a line between said axis and said tab and slot means is at substantially 45°45°or more to the bottom of the second member.

6. The carton defined in claim 3 wherein said first carton member includes finger hole means to facilitate removal of the carton from a corrugated master shipper, and removal of the first member from the second member.

7. The carton defined in claim 3 wherein the second carton member has serrated flaps attached to the upper edges of the trapezoidal side walls at score lines, to retain thin packets disposed therein in upstanding relationship.

8. A method of packing and displaying a plurality of thin packets or the like comprising the steps of disposing the packets in an open-top first carton member in inverted relationship therewith, telescopically sliding a second carton member over the top of the first carton member to form a closure therewith, slidably locking the carton members together by inserting tab means on one of said carton members into slot means in the other of said carton members, whereby the food packets will be packed for shipping; inverting the carton whereby the second member is on the bottom and the first member is on the top, and unpacking the packets for display by, rotating the first carton member about a top edge of one end wall of the second carton member until the tab means is released from the slot means, and telescopically sliding the carton members apart whereby the thin packets are retained in the second carton member.

* * * * *

UNITED STATES PATENT AND TRADEMARK OFFICE

CERTIFICATE OF CORRECTION

PATENT NO. : 3,955,671

DATED : May 11, 1976

INVENTOR(S) : Gary B. Ockey

It is certified that error appears in the above-identified patent and that said Letters Patent are hereby corrected as shown below:

Column 5, Claim 5, line 3, "45°45°" should be --45°--.

Signed and Sealed this

Twenty-sixth Day of October 1976

[SEAL]

*Attest:*

RUTH C. MASON
*Attesting Officer*

C. MARSHALL DANN
*Commissioner of Patents and Trademarks*